United States Patent [19]

Jönsson et al.

[11] 4,015,614

[45] Apr. 5, 1977

[54] APPARATUS FOR WASHING SANITARY CONVENIENCES SUCH AS BED PANS AND THE LIKE

[75] Inventors: Arne Ingvar Jönsson, Getinge; Olov Valdemar Malmström, Halmstad; Bengt Gunnar Julius Tibell, Eskilstuna, all of Sweden

[73] Assignee: Aktiebolaget Electrolux, Stockholm, Sweden

[22] Filed: Aug. 14, 1975

[21] Appl. No.: 604,726

Related U.S. Application Data

[63] Continuation of Ser. No. 437,622, Jan. 29, 1974, abandoned.

[52] U.S. Cl. ..... 134/152; 134/170; 134/171; 134/104

[51] Int. Cl.[2] ..... B08B 3/00; B08B 9/00

[58] Field of Search ..... 134/104, 140, 143, 149, 134/150, 153, 166 R, 169 R, 135, 170, 171, 199, 200, 152, 57 R, 57 DL, 58 R, 58 DL, 95, 99, 167 R, 168 R, 176, 179, 180, 181; 4/1, 112; 239/597, 598

[56] References Cited

UNITED STATES PATENTS

| | | | |
|---|---|---|---|
| 1,153,228 | 9/1915 | Hutaff | 134/152 |
| 1,776,455 | 9/1930 | Thompson | 239/598 |
| 2,951,490 | 9/1960 | Cuillier | 134/149 |
| 3,122,151 | 2/1964 | Chambers | 134/104 |
| 3,645,283 | 2/1972 | Cassells | 134/58 DL |

*Primary Examiner*—Harvey C. Hornsby
*Assistant Examiner*—Robert Pous
*Attorney, Agent, or Firm*—Alfred E. Miller

[57] ABSTRACT

Apparatus which washes and cleans hospital and nursing home utensils of various configurations, such as bed pans, urinals, and buckets. The washing apparatus is provided with a chamber that has washing nozzles and a mounting fixture for the utensils that rotates during the various stages of the washing operation. The utensils of different types are readily and thoroughly cleaned in a sealed, closable chamber, and the switching of the various washing stages may be accomplished by the knee of the operator, leaving the hands free to manipulate the utensils as desired.

3 Claims, 8 Drawing Figures

APPARATUS FOR WASHING SANITARY CONVENIENCES SUCH AS BED PANS AND THE LIKE

This is a continuation of Application Ser. No. 437,622 filed Jan. 29, 1974, and now abandoned.

BACKGROUND OF THE INVENTION

It is known that hospitals and nursing homes are sanitary conveniences for their patients, such as bed pans, urinals, and buckets. These utensils contain feces and urine having a large amount of different types of bacteria. It is therefore important to thoroughly clean these utensils before re-use. Some known cleaning devices of this type do not clean the utensils sufficiently to render an acceptable result. Other known cleaning devices for sanitary conveniences are rather complex to use requiring trained operators.

This invention relates to an apparatus having a closable chamber in which hospital and nursing home utensils may be thoroughly washed and cleaned.

It is an object of the present invention to provide a relatively simple apparatus for effectively washing and cleaning soiled utensils of the type used in hospitals and nursing homes. The apparatus employs a rotatable mounting fixture in the cleanable chamber upon which various utensils may be removably secured thereto. The liquid conduits and ejector nozzles for the washing liquid are so arranged in the chamber as to effectively wash all surfaces of the utensils.

Another object of the present invention is to provide washing nozzles having means for spreading a curtain of the washing liquid over the vertical walls of the chamber.

A further object of the present invention is to provide a console for the closable chamber having a series of closely spaced switches so positioned and proportioned to permit the operator to selectively activate the switches by means of his or her knee.

Another object of the present invention is to provide a washing apparatus for hospital and nursing home utensils or receptacles having sequential working cycles of cold water, warm water, and hot water spray.

Another object of the present invention is to provide an automatic washing apparatus for sanitary convenience utensils that is simple to operate yet effectively cleans the utensils for re-use without any further cleaning.

The invention will now be more fully described with reference to the accompanying drawings, in which.

Figure 1:
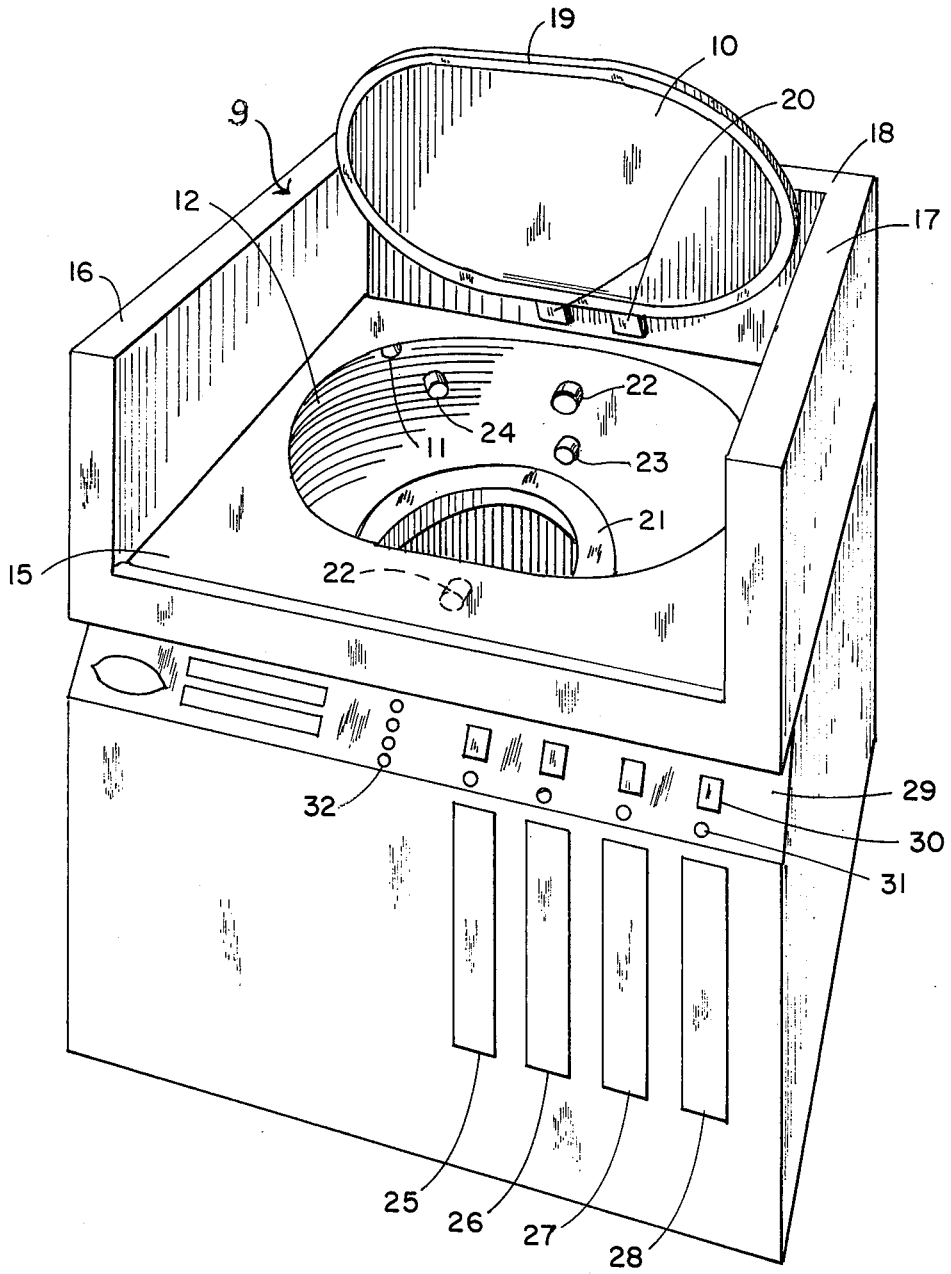
FIG. 1 is a perspective view of the apparatus for washing sanitary conveniences constructed in accordance with the teachings of the present invention in which the cover is shown in an open position with a bed pan resting in the washing chamber.
Figure 3:
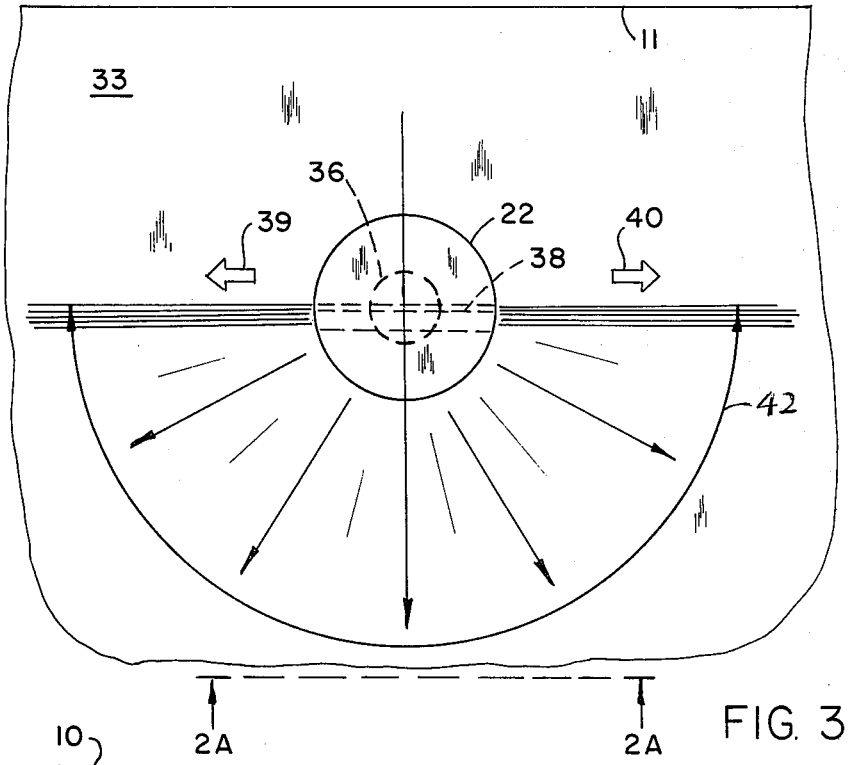
Figure 2:
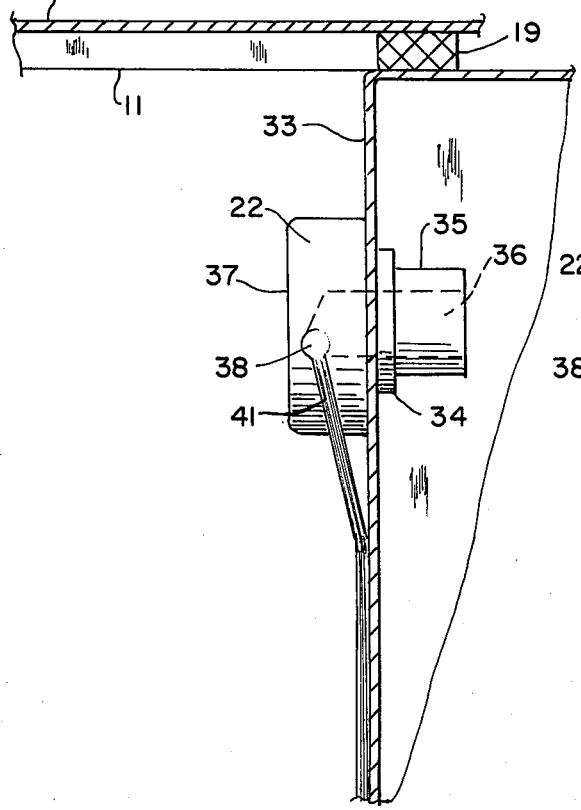
FIG. 2 is a partial sectional and partial elevational view of enlarged details of construction, such as an ejector nozzle.
Figure 2A:
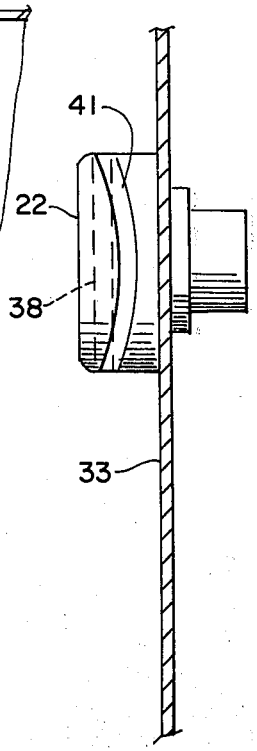
Figure 5:
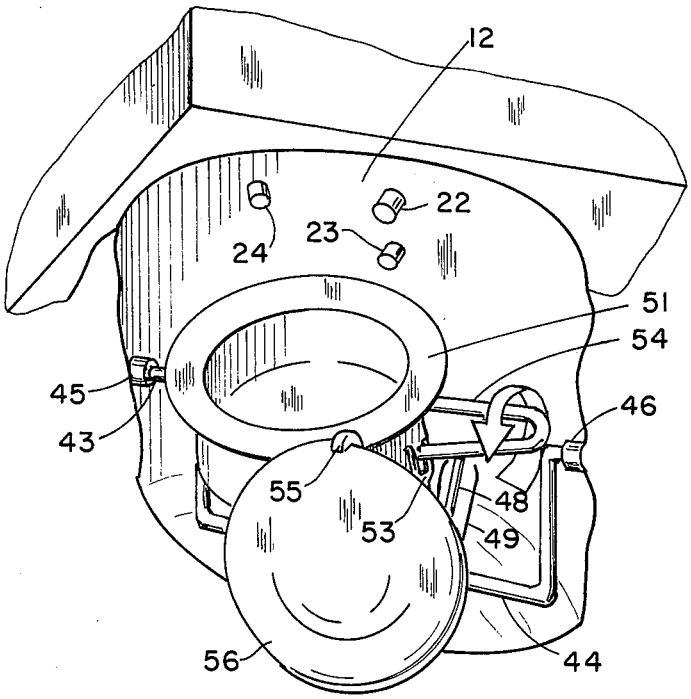
Figure 4:
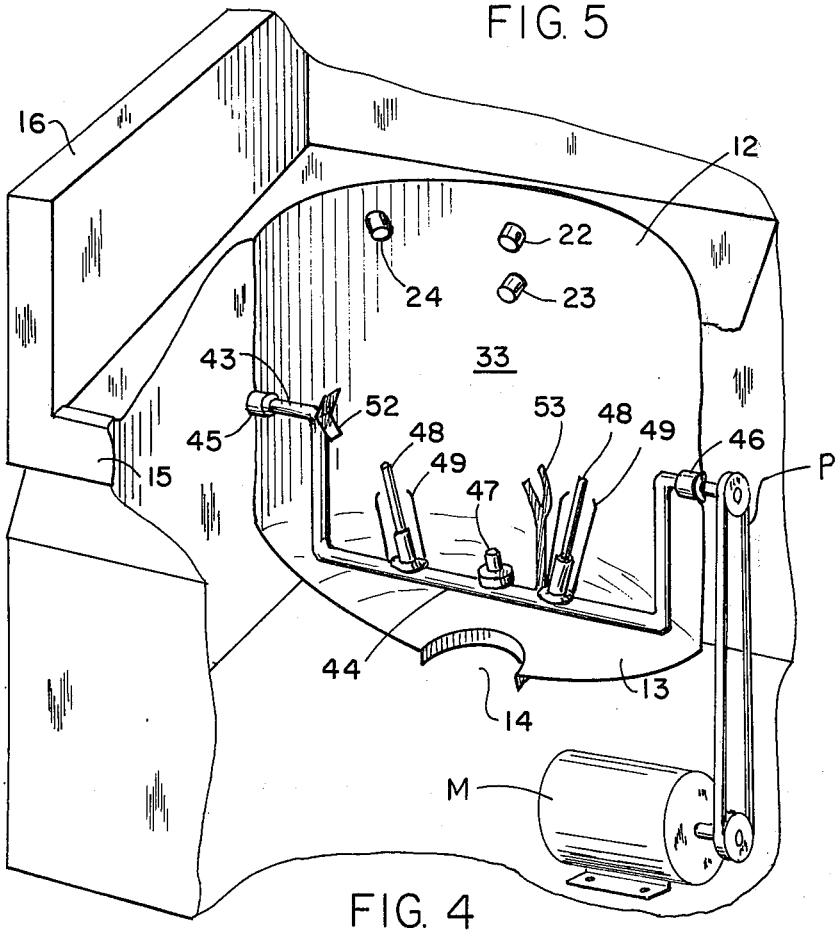
Figure 6:
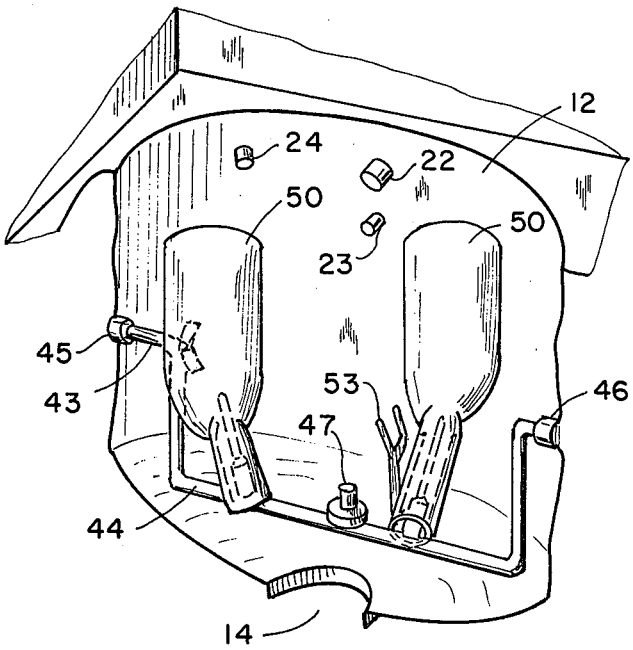
Figure 7:
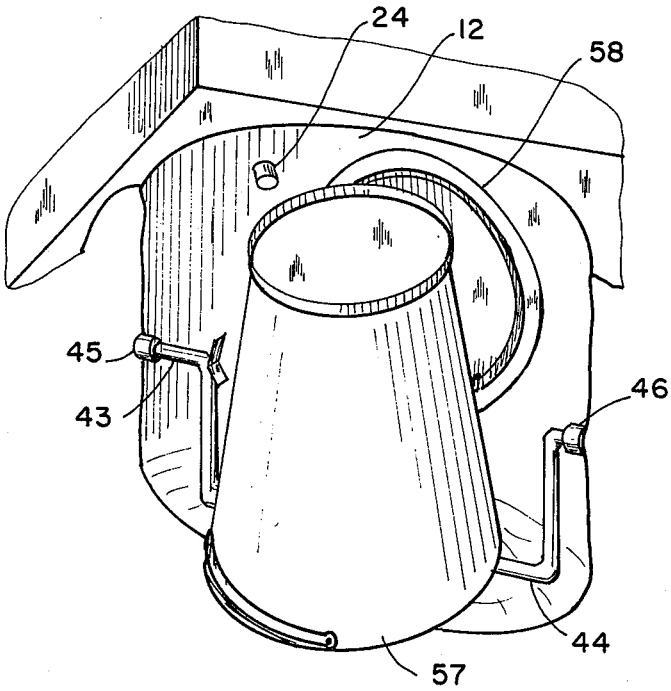

FIG. 2*a* is a view taken along the lines II*a*—II*a* of FIG. 3;

FIG. 3 is a top plan view of the ejector nozzle shown in FIG. 2 and illustrating the liquid dispersion from the ejector nozzle;

FIG. 4 is a perspective view of the washing apparatus similar to that shown in FIG. 1 but with parts broken away for purposes of clarity;

FIG. 5 is a perspective view similar to that shown in FIG. 4, however, showing a crank-shaped shaft holding a bed pan and cover;

FIG. 6 is a perspective view similar to that shown in FIG. 5 disclosing urinals removably secured on the crank-shaped shaft; and FIG. 7 is a perspective view similar to that shown in FIG. 5 showing a bucket removably mounted on the crank-shaped shaft.

DESCRIPTION OF THE PREFERRED EMBODIMENTS OF THE INVENTION

The washing apparatus for hospital and nursing home equipment is referred to generally by the numeral 9 and is provided with an oval-shaped opening 11 in the generally horizontal surface 15. A cover 10 is shown hinged at 20 to the surface 15. Below the oval-shaped opening 11 is a washing chamber 12. The latter has generally vertically shaped walls and a sloping bottom 13 with a central drain opening 14 leading to an outlet conduit having a water seal (not shown). The surface 15 may also be cup-shaped in order to provide for better liquid drainage and this surface is surrounded on three sides by upstanding splash boards 16, 17, and 18, respectively. As seen in FIG. 1, the cover 10 is provided with a peripheral sealing strip 19 that seals the cover to surface 15 when the cover is in the closed position. The cover 10 is also operatively connected to a preferably pneumatic or hydraulic mechanism (not shown) for automatically opening and closing the cover.

Referring to FIG. 1, a portion of a bed pan 21 is illustrated in position in the washing chamber 12. Located slightly below the edge of the opening 11 are a pair of oppositely disposed ejector nozzles 22. Ejector nozzles 23 and 24 are further located below and laterally of the ejector nozzle 22. Jet liquid flow is directed through the ejectors 23 and 24 towards the utensils being washed in the washing chamber 12.

The front of the washing apparatus 9 is provided with four elongated switches 25, 26, 27, and 28 that are designed to be operated by a knee of the user. An inclined panel 29 is located above the front surface housing the above-mentioned switches and has a symbol indicator 30 and a signal light 31 above each of the elongated switches. A plurality of vertically aligned signal lamps 32 are located centrally on the panel 29. The signal lamps 32 indicate the following functions: (1) that the main current is connected, (2) that the washing program is switched on, (3) that the hot water in the supply conduit is at a too low temperature, and (4) that the main fuse is faulty.

FIGS. 2 and 2*a* show the details of construction of the ejector nozzle 22. The nozzle is shown mounted on the vertical wall 33 of the washing chamber 12 by means of a screw-threaded nut 34. The nozzle 22 is shown in FIG. 2 having a threaded portion 35 for the nut 34, and also forming a connection means for a screw-threaded end of the liquid supply conduit (not shown). The nozzle 22 is further shown having a bore 36 that extends forwardly from the rear of the nozzle but not at far as the front surface 37 (FIG. 2). A transverse hole 38 is located at the forward end of bore 36 which communicates with the bore. The nozzle 22, as seen in FIGS. 2 and 2*a*, is further provided with a cut-out 41 extending from a location below the hole 38 up to the same hole. As seen in FIG. 2, the cut-out 41 is at angle toward the wall 33 such that liquid passing through the nozzle 22 and hole 38 will be sprayed substantially horizontally on the wall below the nozzle in opposite directions, as indicated by the arrows 39 and 40 of FIG. 3. The sprayed liquid spreads a curtain over the wall 33 of the washing chamber and covers an angle of 180°, as indicated by the curved arrow 42.

Referring to FIGS. 4-6, a shaft 43 having a crank-shaped portion 44 is shown rotatably journalled in the wall 33 of the washing chamber 12 on a level that is about midway down the wall 33 of the washing chamber 12. One end of the shaft 43 is connected to a suitable motor M by means of a pulley P and sheaves in order to slowly rotate the shaft. The other end of shaft 43 is provided with a pipe connection with valves (not shown) for cold water, warm water, and hot water supply conduits, respectively. The shaft 43 is illustrated as journalled in bearings 45 and 46; moreover, the crank 44 has a central ejector nozzle 47 which directs a fluid flow in the center of the washing chamber 12. Two longer ejector nozzles 48 are mounted on the crank 44 on either side of central ejector nozzle 47. The ejector nozzles 48 are located obliquely relative to the center of the chamber and are surrounded by resilient holders 49 for urinals 50, as seen in FIG. 6.

As shown in FIG. 4, the shaft 43 has two clamping springs to hold the bed pan 51 in a manner shown in FIG. 5. One clamping spring 52 is located adjacent to the junction between the crank 44 and the shaft 43 and is adapted to be inserted under the peripheral flange of the bed pan 51. The other clamping spring 53 is forked-shaped (FIGS. 4–5) and is adapted to permit the insertion of the handle 54 of the bed pan 51 therein. A holder 55 for the bed pan cover 56 is shown mounted on the crank 44 of shaft 43 (FIG. 5).

As seen in FIG. 7, the bucket 57 together with its cover 58 are positioned within the washing chamber 12. The bucket is placed in an inverted position on the crank 44 of the shaft 43.

It should be understood that the present washing apparatus for bed pans as shown in FIG. 5 is intended to be operatively connected to a source of electric power (not shown) for rotation of the shaft 43 and for operating the control systems and valves of the apparatus. The present washing apparatus is also connected to supply conduits (not shown) for cold, warm, and hot water. Furthermore, the drain opening 14 in the bottom 13 of the washing chamber is connected to an outlet conduit (not shown).

The cover 10 shown in FIG. 1 may be operated by means of compressed air or by means of an hydraulic system. Moreover, in the event that a supply of hot water is not available, the water may be heated in the apparatus by means of a hot water heater accommodated in the base of the apparatus, or adjacent thereto.

The washing apparatus constructed in accordance with the teachings of the present invention operates as follows: The first left hand switch 25 is depressed in order to automatically elevate the cover 10. Thereafter, either the urinals 50 or the bucket 57 with the cover 58 is placed in the washing chamber 12. The second switch 26 is then depressed causing the cover 10 to be closed automatically and the spraying of the utensils is achieved in the sequence by cold water, warm water, and hot water. It is preferred to spray the hot water only through the ejector nozzles on the crank portion 44 of the shaft 43. Inasmuch as the utensils have a final spray of hot water, these can dry quickly in the closed chamber 12. Thereafter, the first switch 25 is again depressed whereby the cover is opened and the utensils are accessible for removal. When the third switch from the left 27 is depressed, the ejector nozzle 22 operates to spray liquid on the wall 33 of the washing chamber 12, as seen in FIG. 3.

The fourth switch from the left 28 is used when it is desired to wash bed pans 51. Thus, the bed pan 51 and cover 56 are secured in the washing chamber 12 in accordance with the arrangement shown in FIG. 5. Thereafter, the switch 28 is depressed and the cover 10 is closed automatically. Initially, the wall 33 of the washing chamber 12 is sprayed by ejector nozzles 22, thereby removing feces and urine from the wall 33 and the bottom 13 of the chamber. Simultaneously, the bed pan 51 and cover 56 are sprayed with cold water by the nozzles 23 and 24 located in the wall 33 and the nozzles 47 and 48 on the crank 44 of the shaft 43. During this washing program, the bed pan and cover rotates when the shart 43 rotates, and they are sprayed with warm water and thereafter with hot water, for example by means of ejector nozzles 23 and 24. The temperature of the hot water should be high enough to decontaminate the utensils in the washing chamber. After the washing program has been completed, the apparatus stops with the crank turned upwards and the bed pan positioned so that its opening is turned downwardly. In this position, the hot water remaining in the bed pan 51 flows out, and the cover 56 drys due to the heat remaining in the closed washing chamber 12. After the bed pan and cover are dried, the switch 25 is then depressed whereby the shaft 43 is rotated 180° and the bed pan 51 is positioned with its opening turned upwardly. At the same time, the cover 10 of the washing chamber 12 assumes an open position.

The ejector nozzles are so positioned in the washing chamber of the washing apparatus in order to effectively clean utensils having a variety of configurations. Furthermore, the apparatus is constructed to be used by hospital and nursing home personnel and requires only a minimum amount of instruction.

What is claimed is:

1. Apparatus for washing bed pans and similar articles comprising a housing provided with a chamber, a cover for said chamber, a liquid supply, a plurality of nozzles mounted on the wall of said chamber and connected to said liquid supply whereby the wall of said chamber as well as the exterior surfaces of said articles are sprayed with liquid, a crank-shaped pipe being rotatably journalled in and extending across said chamber, motor means for slowly rotating said pipe, and said pipe being positioned in a generally horizontal plane and having at least one ejector nozzle and means for conducting liquid thereto, said pipe additionally being provided with at least one holder for holding said articles, both said ejector nozzle and said holder being mounted on said crank-shaped pipe, said articles removably held on said crank-shaped being pipe while being sprayed internally with liquid that passes through said pipe by said holders and said ejector nozzle, and one of said nozzles having a central bore for the liquid supply and a connecting channel located substantially transverse thereto, a relatively wide cut-out passage located at an angle with respect to the wall of the chamber and joined to said connecting channel for conducting the liquid supply from said connecting channel through said cut-out passage in the form of a liquid spray whereby the wall of the washing chamber is sprayed with a liquid curtain that covers approximately an angle of 180°.

2. Apparatus as claimed in claim 1 wherein said holder for a bed pan is a pair of clamping elements, one of said elements being disposed at the junction of the shaft and said crank-shaped pipe, and the other of said elements being bifurcated and having the handle of the bed pan resting therein.

3. Apparatus as claimed in claim 1 wherein two spaced ejector nozzles are located on said crank-shaped pipe of said shaft, and a resilient holder surrounding each of said ejector nozzles whereby urinals may be removably held thereon.

* * * * *

UNITED STATES PATENT OFFICE

CERTIFICATE OF CORRECTION

PATENT NO. : 4,015,614

DATED : April 5, 1977

INVENTOR(S) : Arne Ingvar Jonsson, Olov Valdemar Malmstrom, Bengt Gunnar Julius Tibell It is certified that error appears in the above-identified patent and that said Letters Patent are hereby corrected as shown below:

Claim 1, line 1, after the word "similar" insert --open ended--;
line 14, after the word "cles" insert --for rotation to positions in which said articles alternately have their closed and open ends facing downwardly--;
line 15, after the word "articles" insert --being--;
line 16, after the word "shaped" delete the word "being";
line 16, after the word "pipe" insert --by said holder--
line 18, after the word "pipe" delete "by said holders--

Signed and Sealed this

*twelfth* Day of *July 1977*

[SEAL]

*Attest:*

RUTH C. MASON
*Attesting Officer*

C. MARSHALL DANN
*Commissioner of Patents and Trademarks*